US007744307B2

(12) United States Patent
Moor et al.

(10) Patent No.: US 7,744,307 B2
(45) Date of Patent: Jun. 29, 2010

(54) METHOD FOR RENOVATING OF A TRAFFIC-CARRYING STRUCTURE

(75) Inventors: Gianni Moor, Zürich (CH); Bernd Urich, Eglisau (CH); Eduard Schiebelbein, Embrach (CH); Ernst-Peter Laich, Schaffhausen (CH)

(73) Assignee: Mageba, S.A., Bülach (CH)

( * ) Notice: Subject to any disclaimer, the term of this patent is extended or adjusted under 35 U.S.C. 154(b) by 43 days.

(21) Appl. No.: 12/089,958

(22) PCT Filed: Oct. 6, 2006

(86) PCT No.: PCT/EP2006/009675

§ 371 (c)(1),
(2), (4) Date: May 7, 2008

(87) PCT Pub. No.: WO2007/042213

PCT Pub. Date: Apr. 19, 2007

(65) Prior Publication Data

US 2008/0247822 A1 Oct. 9, 2008

(30) Foreign Application Priority Data

Oct. 12, 2005 (EP) ..... 05022200

(51) Int. Cl.
*E01C 7/06* (2006.01)
*E01C 7/32* (2006.01)

(52) U.S. Cl. ..... 404/75

(58) Field of Classification Search ..... 404/72, 404/75, 17; 14/73.5, 77.1, 78
See application file for complete search history.

(56) References Cited

U.S. PATENT DOCUMENTS 3,367,074 A * 2/1968 Francesco ..... 52/223.9
3,981,601 A * 9/1976 Arai ..... 404/68
4,021,638 A 5/1977 Asakura
4,145,153 A * 3/1979 Fasullo et al. ..... 404/73
4,784,516 A * 11/1988 Cox ..... 404/69

(Continued)

FOREIGN PATENT DOCUMENTS

DE 10108907 A1 10/2002

(Continued)

OTHER PUBLICATIONS

English Translation of the Preliminary Report on Patentability for International Application No. PCT/EP2006/009675 mailed May 8, 2008.

*Primary Examiner*—Thomas B Will
*Assistant Examiner*—Abigail A Risic
(74) *Attorney, Agent, or Firm*—Myers Wolin, LLC

(57) ABSTRACT

In order to repair a bridge in the zone of an expansion joint initially at least the near-surface components of the bridging device that is to be replaced are dismounted and the existing lane structure in the zones bordering the bridging device that is to be replaced is removed in the areas facing the abutment and the superstructure so as to form recesses placed at a lower level than the lane surface, whereupon a temporary bridging element located at the ground level is removably mounted. In order to entirely dismount one section of the bridging device that is to be replaced after another and perform preparatory work for assembling a new permanent bridging device, at least the bridging plate is repeatedly removed and re-assembled as required.

17 Claims, 1 Drawing Sheet

U.S. PATENT DOCUMENTS

| | | | | |
|---|---|---|---|---|
| 4,793,162 | A * | 12/1988 | Emmons | 404/69 |
| 5,406,663 | A * | 4/1995 | Chen | 14/75 |
| 6,039,503 | A * | 3/2000 | Cathey | 404/67 |
| 6,808,335 | B2 * | 10/2004 | Stamm et al. | 404/72 |
| 7,144,190 | B1 * | 12/2006 | Lyons | 404/31 |
| 2002/0157338 | A1 * | 10/2002 | Jesko | 52/396.04 |
| 2004/0228685 | A1 * | 11/2004 | Polivka, Jr. | 404/75 |
| 2005/0141961 | A1 * | 6/2005 | Steffes | 404/75 |
| 2006/0034652 | A1 * | 2/2006 | Sanders | 404/17 |

FOREIGN PATENT DOCUMENTS

| | | | |
|---|---|---|---|
| EP | 1288394 | A | 3/2003 |
| EP | 1469128 | A | 10/2004 |

* cited by examiner

METHOD FOR RENOVATING OF A TRAFFIC-CARRYING STRUCTURE

CROSS REFERENCE TO RELATED APPLICATIONS

This is a national phase filing under 35 U.S.C. §371 of International Patent Application EP/2006/009675 filed Oct. 6, 2006, which claims priority to EP Application 05022200.9, filed Oct. 12, 2005, the contents of which are incorporated herein by reference in its entirety.

BACKGROUND OF THE INVENTION

Filed of the Invention

The present invention relates to a method for renovation of a traffic-carrying structure in the zone of an expansion joint that exists between an abutment and a superstructure.

Bridges and comparable traffic-carrying structures are provided with expansion joints, which are intended in particular to compensate for thermal expansions of the superstructure and with which there are associated bridging devices, on which the traffic can roll for different widths of the expansion joint. Such bridging devices, which are known in the most diverse embodiments, are designed in principle for long life. Nevertheless, renovations of bridges and other traffic-carrying structures, accompanied by renewal of the bridging devices, are becoming increasingly necessary, in many cases not the least because of a massive increase of traffic density and/or vehicle weights far beyond the original design values.

Such renovation operations associated with renewal of the bridging device necessitate either that the bridges in question be closed, at least to the extent of one of the highway directions; this results in relatively prolonged impairment of and inconvenience to traffic, due either to a reduction of the total lanes available on the bridge in question or to rerouting of the traffic onto detours, which in turn are then frequently overloaded and/or must first be laboriously prepared to accommodate the corresponding traffic (for example, by increasing the overhead clearances and similar measures). Alternatively, an auxiliary construction ("flyover") is erected in the zone of the expansion joint, with a first ramp associated with the abutment and a second associated with the superstructure, in which case the traffic is routed via the auxiliary construction during the renovation operations on the underlying bridging device. Such auxiliary constructions are used in particular when reasonable detours are not available. To ensure that adequate free space to carry out the renovation operations remains under the auxiliary construction and that a permissible gradient is not exceeded, however, the ramps need considerable length, which is associated with correspondingly high construction expense for erection and subsequent removal of the auxiliary construction. Moreover, the traffic routed over the auxiliary construction experiences considerable interference because of the necessary restriction of the maximum speed permissible for driving over the auxiliary construction.

SUMMARY OF THE INVENTION

Accordingly, the present invention is directed at providing a method for renovation of a traffic-carrying structure in the zone of an expansion joint existing between an abutment and a superstructure, which method is characterized by particularly low overall expense and in which the traffic experiences only minimal interference during the renovation operations.

According to the present invention, the method for renovation of a traffic-carrying structure in the zone of an expansion joint existing between an abutment and a superstructure comprises the following steps:

- removing existing road construction in the abutment side and superstructure side in the zones adjoining the bridging device to be replaced by forming, in the abutment and superstructure, excavations that are deeper than the road surface, at least a first excavation having a surface running substantially parallel to the associated road surface;
- demounting at least that component of the bridging device to be replaced which forms the traffic-carrying surface;
- detachably mounting, in a manner free of damage, a temporary bridging element, which comprises a bridging plate and a mating plate meshing therewith in the zone of a finger array, and whose surface adjoins the road surfaces of abutment and superstructure adjacent to the respective excavation in a manner that is substantially free of gaps, uneven levels and angles, the bridging plate being braced in the zone of the finger array on the bottom of the first excavation;
- as needed, repeatedly removing the bridging plate for section-by-section performance of the complete demounting of the bridging device to be replaced to a level under the road surface and, if necessary, of preparatory operations for mounting a new permanent bridging device and respective subsequent remounting of the bridging plate;
- removing the temporary bridging element and mounting a new permanent bridging device.

One of the essential technical aspects of the present invention therefore comprises formation of excavations in the two zones of the road construction adjoining the bridging device to be replaced. The finger array, in the zone of which the bridging plate and the mating plate of the temporary bridging element mesh with one another, is received in one of these excavations. The temporary bridging element is braced in the corresponding excavation in the zone of the finger array. This permits the inventive use of a temporary bridging element, which will be repeatedly opened and closed as needed according to the progress of the renovation operations, despite the complete removal of all components of the bridging device to be replaced in the course of the renovation operations. To this extent the opportunities for use of the present invention go significantly beyond the conceivable use of a ground-level temporary bridging element during repair of a bridging device, because the components forming the traffic-carrying surface (such as cantilevered segments) are replaced, but the load-bearing members (such as crossbars) of the bridging device are preserved, and so a temporary bridging element can be braced, especially in the zone of a finger array, on the load-bearing members of the bridging device that are available even during the repair operations.

The present invention is based substantially on the knowledge that the possibility of individual and flexible performance of the renovation operations within definite time windows by appropriate setup of the construction site and adaptation thereof to the respective traffic conditions not only favorably affects the total expense for performing the renovation operations but also can contribute to minimizing the total interference with traffic that occurs during performance of the renovation operations. Specifically, by application of the present invention, closing of the bridge or of the highway direction or lane in question in order to perform the renovation operations can be limited in particular to light traffic periods, for example to nighttime hours or to the weekend, whereas in the remaining heavy traffic periods the traffic is (also) routed over the temporary bridging element; thus, except for the closures established individually in light traffic periods, all lanes can remain continuously available for traffic despite performance of the renovation operations. If several lanes per highway direction are available, the renovation operations can be performed successively for the individual lanes, with relatively low expense, by application of the present invention. If in this context the renovation operations are restricted exclusively to only one of the lanes, those lanes not being renovated at this time always remain available in the light traffic period despite construction-site operations; and in heavy traffic periods the lane routed over the temporary bridging element is additionally available. Since the surface of the temporary bridging element adjoins the adjacent road surface in flush manner, substantially without gaps, uneven levels and/or angles, the maximum speed of the traffic routed over the temporary bridging element does not have to be limited, at least not notably, and so to this extent also no interference exists. The additional construction expense for erecting and subsequently removing the temporary bridging element is reasonably low. The same is true for the intermittent temporary removal and remounting of the bridging plate as needed for section-by-section performance of the renovation operations while the highway or one of its directions is closed. By application of the present invention, therefore, it is only for the minimal traffic flow during light traffic periods that restriction to a reduced number of lanes or establishment of bypass routes or detours is necessary, but not for the usual average traffic or even the traffic flowing during peak hours.

A first preferred improvement of the inventive method is characterized in that, at least for the first excavation, a rough excavation deeper than the thickness of the finger array of the temporary bridging element is made for the time being, after which a layer of polymer concrete is applied on the surface of the rough excavation and the bridging plate is placed slidingly on the surface thereof in the zone of the finger array. In this connection, it is particularly favorable for the depth of the rough excavations to correspond to the thickness of the adjoining pavement (such as asphalt). These measures contribute to minimizing the time for erection of a functional temporary bridging element and thus the necessary duration of a first traffic closure. Furthermore, by virtue of the special properties of polymer concrete, a separate support plate is not needed in this case to provide sliding bracing for the bridging plate. Instead of polymer concrete, a suitable sealing mortar or comparable material could also be used with comparable advantages.

According to another preferred improvement of the invention, the components of the temporary bridging element are bolted together with the abutment or the superstructure, and for this purpose at least one of the components of the temporary bridging element is expediently provided with bores for fastening bolts. This is particularly advantageous with regard to the capability of removing and remounting the bridging plate repeatedly within a very short time without jeopardizing the reliability of fixation of the mounted bridging plate thereunder. If needed, the components of the temporary bridging element can also be secured in position by additional interlocking with the abutment or the superstructure, for example in the form of meshing recesses and projections on the components of the temporary bridging element on the one hand and the abutment or superstructure on the other hand.

Yet another preferred improvement of the invention is characterized in that the temporary bridging element is composed of a plurality of sectional segments disposed next to one another in the longitudinal direction of the expansion joint. This facilitates local manipulation of the components of the temporary bridging element using tools that are available on the construction site in any case. If the renovation operations are planned in lane-by-lane stages in the sense mentioned hereinabove, the width of the temporary bridging element must obviously be matched to the width of the respective lane to be renovated, in which case segmentation of the bridging plate as explained in the foregoing is beneficial even for temporary bridging elements over which only the traffic of a single lane is to be routed. By virtue of the flexible plate widths, almost unlimited allowance can be made for needs of the customer with regard to the subdivision of stages or to the chronological sequence of the individual surfaces.

Particularly preferably, the temporary bridging element is asymmetric and is composed merely of a bridging plate and a mating plate, which if necessary are subdivided in the longitudinal direction of the joint. In this case the bridging plate and the mating plate mesh with one another in the zone of a finger array. This permits a particularly simple structural design of the temporary bridging element with favorable static conditions, and also a particularly small expense is associated with opening up the installation space of the bridging device in order to perform renovation operations and with closing that installation space once again. For stiffening, the bridging plate can be provided with stiffening ribs, especially on its underside; this permits particularly lightweight design of the bridging plate with adequate static and dynamic loadability, and so it is compatible with the necessary repeated manipulation of the bridging plate on the construction site. In view of the fact that the renovation operations will be completed within an acceptable period amounting to at most several weeks, the flexibility of movement of the temporary bridging element is permitted to be less than the flexibility of movement of the permanent bridging device—which must be designed for year-round operation under extreme conditions. This is yet another aspect that emphasizes the particular advantages of the relatively simple and low-cost design of the temporary bridging element to be used in connection with the present invention.

According to yet another preferred improvement of the invention, the bridging plate is secured by means of a bracing device that prevents it from being lifted. Particularly preferably, this bracing device in the expansion joint is applied against the abutment and/or the superstructure. Such securing of the bridging plate in position by means of a bracing device permits the use of a relatively lightweight bridging plate, to the extent permitted by the static conditions. This is also compatible with the fundamental principle of the present invention, which is based on repeated demounting and remounting of the bridging plate as needed, using standard construction-site equipment.

A further preferred improvement of the invention is characterized in that a quickly placeable pavement transition is mounted as the new bridging device, for example in the form of a Robo Flex "RE-LS" pavement transition or of a "Tensa Flex" sliding finger joint, both of which are offered by the Applicant. The rapid placement capability is based largely on the fact that the respective permanent bridging device is bolted together with the superstructure or is cast with quick-setting Robo Flex polymer concrete. The preparations for mounting bridging devices of this type can be achieved to such an extent during the night that they can be placed completely at night in the extreme case or if necessary during a brief additional closure period, after which the traffic can roll over them without further delay. In this connection, it is particularly preferable after mounting of the permanent bridging device to cast zones of the pavement along the sides thereof with polymer concrete, in which case retaining portions of the components of the permanent bridging device can be cast in place—for (additional) securing of the position of the components—especially during casting of the pavement zones of polymer concrete. All of these measures are already suitable independently of one another, but especially so in combination with one another, for accelerating mounting of the permanent bridging device and shortening the time until the permanent bridging device can carry traffic, specifically to a few hours, if necessary, after the bridging device has been placed. In light of the principle that underlies the present invention and that is based on intermittent closures of the bridge, in each case for a short time, this is a significantly advantageous viewpoint.

The present invention can obviously be employed in connection with renovation of the most diverse traffic-carrying structures. If the bridging device to be replaced is a pavement transition of cantilevered-segment type, two excavation cuts are expediently made respectively on the abutment side and on the superstructure side in the road construction during demounting thereof, the two outer excavation cuts extending substantially over the thickness of the pavement, and the two inner excavation cuts extending to below the lower edge of the crossbar boxes. Such a procedure accelerates the demounting operations and the preparation for and performance of mounting of the new bridging device, thus contributing both to the shortest possible total duration of the renovation operations and to minimization of the individual closure times.

BRIEF DESCRIPTION OF THE DRAWINGS

The present invention will be explained in more detail hereinafter on the basis of a preferred exemplary embodiment illustrated in the drawing, wherein.

DETAILED DESCRIPTION OF THE PREFERRED EMBODIMENTS

Figure 1:
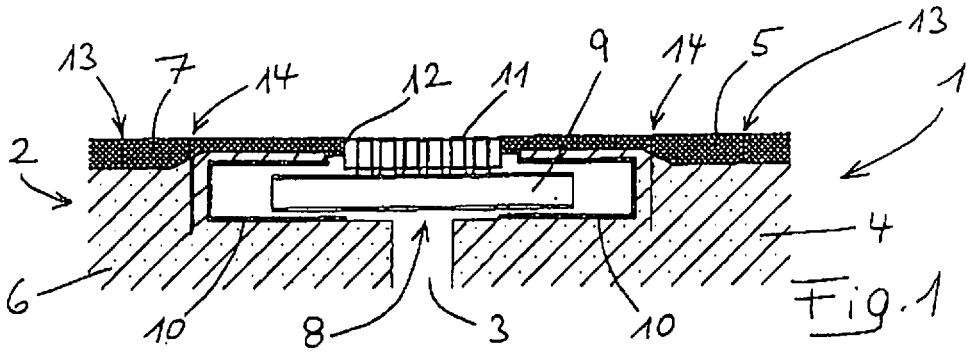
FIG. 1 shows a vertical section through a bridge structure to be renovated in the zone of one of the expansion joints between abutment and superstructure.

The bridge structure shown in the drawing comprises an abutment 1 and a superstructure 2, between which there extends an expansion joint 3. Abutment 1 comprises a substructure 4 and a pavement 5; and superstructure 2 comprises a substructure 6 and a pavement 7. Expansion joint 3 between abutment 1 and superstructure 2 is bridged for the time being by means of a bridging device 8, which is in need of renewal. This has the form of a pavement transition of cantilevered-segment type; it comprises a plurality of crossbars 9, whose ends are received and braced in crossbar boxes 10 on the abutment side and superstructure side respectively. On the crossbars there are braced six cantilevered segments 11 aligned parallel to the joint. Since structures of this type have long been known and structural details are not pertinent for explaining the present invention, no further explanation of bridging device 8 to be renewed will be given.

As illustrated in FIG. 1, two substantially vertical excavation cuts extending in the longitudinal direction of the joint are made for the time being in the road construction both on the abutment side and on the superstructure side. The two outer excavation cuts 13 extend downward for substantially the thickness of pavements 5 and 7 respectively. In contrast, the two inner excavation cuts 14 running relatively close to the ends of crossbar boxes 10 extend to below the lower edge of crossbar boxes 10. Thereafter pavements 5 and 7 are removed between the two outer excavation cuts 13. Furthermore, everything that would hinder mounting of the temporary bridging element (see FIGS. 2 to 4) is stripped or removed, namely cantilevered segments 11, profiled rims 12 and the layers of substructures 4 and 6 of abutment 1 and superstructure 2 covering crossbar boxes 10.

Figure 2:
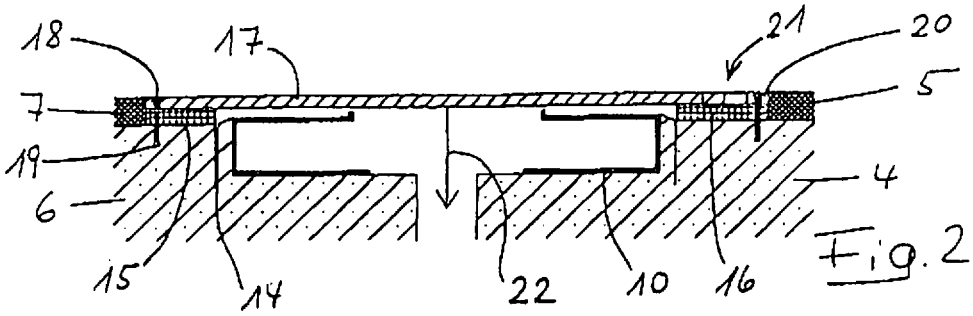
FIG. 2 shows a vertical section according to FIG. 1 after the bridging device to be replaced has been partially demounted in a first stage and a temporary bridging element has been mounted.

Two rough excavations are produced by the corresponding excavation operations; on the surface of the two rough excavations, there are then applied layers 15 and 16 respectively of polymer concrete in the zone between the two excavation cuts 13 and 14. The thickness of polymer-concrete layers 15 and 16 is chosen such that the height of the remaining excavation produced corresponds substantially to the thickness of the temporary bridging element at its rim. On the superstructure side, a bridging plate 17 resting on corresponding polymer-concrete layer 15 is mounted specifically by means of bolts 18, which are screwed into threaded bushes 19, which have been sunk into substructure 6 and associated polymer-concrete layer 15. On the abutment side, a mating plate 20 resting on corresponding polymer-concrete layer 16 is also mounted specifically by means of bolts, which are screwed into threaded bushes, which have been sunk into substructure 4 and associated polymer-concrete layer 16. (Obviously the bridging plate could be mounted on the abutment side and the mating plate on the superstructure side, in just the same way.) Bridging plate 17 spanning the expansion joint and mating plate 20 mesh with one another in the zone of a standard finger array 21, together forming the temporary bridging element. In this connection, the bridging plate is braced in the zone of finger array 21 slidingly on the surface of polymer concrete layer 16 of the abutment side. In this condition, the bridge structure can again carry traffic without restrictions. In FIG. 2, arrow 22 schematically indicates how bridging plate 17 is secured against being lifted by means of a bracing device, which is anchored in the zone of expansion joint 3 against substructure 4 of abutment 1 or substructure 6 of superstructure 2.

Figure 3:
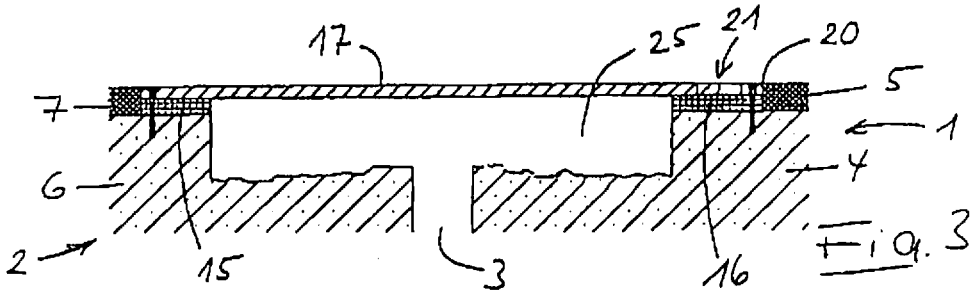
FIG. 3 shows a vertical section according to FIGS. 1 and 2 after the bridging device to be replaced has been partially demounted in a second stage, while the temporary bridging element is still mounted.
Figure 4:
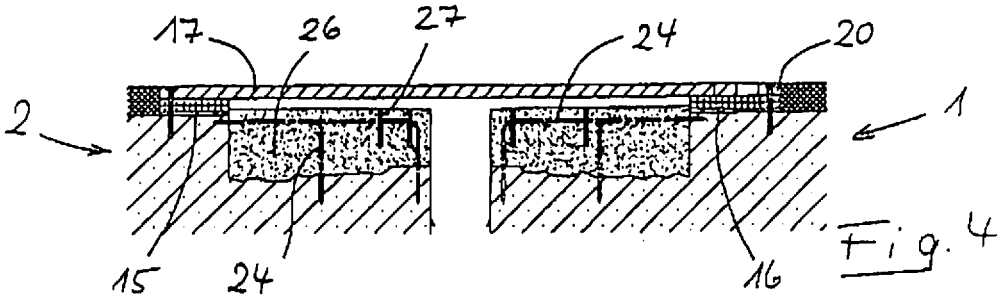
FIG. 4 shows a vertical section according to FIGS. 1 to 3 after preparatory operations for mounting of a new permanent bridging device have been carried out, while the temporary bridging element is still mounted.

Thereafter the further demounting operations are carried out progressively, specifically for each temporarily removed bridging plate 17. In particular, crossbars 9 and crossbar boxes 10 are removed and the anchor loops of the profiled rims, neighboring reinforcements as well as the material of substructures 4 and 6 are excavated to inner excavation cuts 14. The condition after these further, successive, intermittently performed demounting operations is illustrated in FIG. 3.

Figure 5:
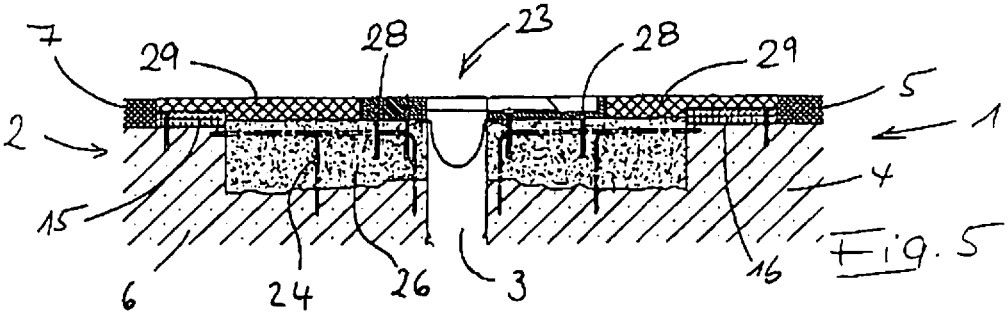
FIG. 5 shows a vertical section according to FIGS. 1 to 4 after mounting of the new permanent bridging device has been completed (illustrating Tensa Flex sliding finger).

These are now followed, again in successive intermittent manner for each temporarily removed bridging plate 17, by the preparatory operations for mounting the new permanent bridging device 23 (FIG. 5), especially the introduction of structural reinforcements 24, the attachment of end forms with formwork sheets against the two substructures 4 and 6, the backfilling of excavation spaces 25 with concrete 26 and the placement of threaded bushes 27. Once again, the bridge structure can carry traffic over the temporary bridging element without restriction between the individual operations.

The last construction phase then comprises—after removal both of bridging plate 17 and mating plate 20—mounting of new bridging device 23, which in the illustrated exemplary embodiment is a "Tensa Flex" finger joint of the Applicant, including mounting of the drainage channel and laying of sealing films on both sides. The two main components of the bridging device are mounted and secured in place via bolts 28, which are screwed into the aforesaid threaded bushes 27. Finally the remaining open spaces of the two excavations are backfilled with a pavement supplement 29 of polymer concrete. Immediately after pavement supplements 29 have set, the bridge structure can carry traffic without restriction.

The invention claimed is:

1. A method for renovation of a traffic-carrying structure in the zone of an expansion joint existing between an abutment and a superstructure, comprising:

removing existing road construction in the abutment side and superstructure side in the zones adjoining a bridging device to be replaced by forming, in the abutment and superstructure, excavations that are deeper than the road surface, at least a first excavation having a surface running substantially parallel to the associated road surface;

demounting at least a part of the bridging device to be replaced which forms the traffic-carrying surface;

removably mounting a temporary bridging element, which comprises a bridging plate spanning the expansion joint and a mating plate meshing therewith in a zone of a finger array, and whose surface adjoins the road surfaces of abutment and superstructure adjacent to the respective excavation in a manner that is flush with the road surfaces of abutment and superstructure and substantially free of gaps, uneven levels and angles, the bridging plate being braced in the zone of the finger array on the bottom of the first excavation;

repeatedly removing the temporary bridging plate and remounting the temporary bridging plate until the remaining parts of the bridging device to be replaced are completely demounted at a level under the road surface and the site is prepared for mounting a new permanent bridging device;

removing the temporary bridging element and mounting the new permanent bridging device;

wherein at least for the first excavation, a rough excavation deeper than the thickness of the finger array of the temporary bridging element is made, after which a layer of polymer concrete or sealing mortar is applied on the surface of the rough excavation and the temporary bridging plate is placed slidingly on the surface thereof in the zone of the finger array.

2. A method according to claim 1, wherein the depth of the rough excavations corresponds to the thickness of an adjoining pavement.

3. A method according to claim 1, wherein components of a temporary bridging element are bolted together with at least one of the abutment and the superstructure.

4. A method according to claim 3, wherein the components of the temporary bridging element are secured in position by additional interlocking with at least one of the abutment and the superstructure.

5. A method according to claim 1, wherein the temporary bridging element is composed of a plurality of sectional segments disposed next to one another in the longitudinal direction of the expansion joint.

6. A method according to claim 1, wherein the temporary bridging element is asymmetric and further comprises a bridging plate and a mating plate.

7. A method according to claim 1, wherein the bridging plate is secured by means of a bracing device that prevents it from being lifted.

8. A method according to claim 7, wherein the bracing device in the expansion joint is applied against at least one of: the abutment and the superstructure.

9. A method according to claim 1, wherein after mounting the permanent bridging device, zones of the pavement along the sides thereof are cast with polymer concrete.

10. A method according to claim 9, wherein retaining portions of the components of the permanent bridging device are cast in place during casting of the pavement zones of polymer concrete.

11. A method according to claim 1, wherein the bridging device to be replaced is a cantilevered segment type pavement transition and wherein to demount said pavement two excavation cuts are made respectively on the abutment side and on the superstructure side in the road construction, the two outer excavation cuts extending to a depth of substantially the thickness of the pavement, and the two inner excavation cuts extending to below the pavement.

12. A method according to claim 1,wherein closure times while the bridging plate is demounted are limited to at least one of light-traffic nighttime and weekend periods.

13. A method for renovation of a traffic-carrying structure in the zone of an expansion joint existing between an abutment and a superstructure, comprising:

removing existing road construction in the abutment side and superstructure side in the zones adjoining a bridging device to be replaced by forming, in the abutment and superstructure, excavations that are deeper than the road surface, at least a first excavation having a surface running substantially parallel to the associated road surface;

demounting at least a part of the bridging device to be replaced which forms the traffic-carrying surface;

removably mounting a temporary bridging element, which comprises a bridging plate spanning the expansion joint and a mating plate meshing therewith in a zone of a finger array, and whose surface adjoins the road surfaces of abutment and superstructure adjacent to the respective excavation in a manner that is flush with the road surfaces of abutment and superstructure and substantially free of gaps, uneven levels and angles, the bridging plate being braced in the zone of the finger array on the bottom of the first excavation;

repeatedly removing the temporary bridging plate from the mating plate and remounting the temporary bridging plate until the remaining parts of the bridging device to be replaced are completely demounted at a level under the road surface and, the site is prepared for mounting a new permanent bridging device; and removing the temporary bridging element and mounting a new permanent bridging device.

14. A method according to claim 13, wherein components of the temporary bridging element are bolted together with at least one of the abutment and the superstructure.

15. A method according to claim 13, wherein the bridging plate and mating plate are asymmetric.

16. A method according to claim 13, wherein the bridging plate is secured by means of a bracing device that prevents it from being lifted.

17. A method according to claim 13, wherein at least for the first excavation, a rough excavation deeper than the thickness of the finger array of the temporary bridging element is made, after which a layer of polymer concrete or sealing mortar is applied on the surface of the rough excavation and the temporary bridging plate is placed slidingly on the surface thereof in the zone of the finger array.

* * * * *